US010053357B2

(12) United States Patent
Achatz et al.

(10) Patent No.: US 10,053,357 B2
(45) Date of Patent: Aug. 21, 2018

(54) FILLING ADAPTER COMPRISING AN INTERFACE FOR COUPLING A HANDLE

(71) Applicant: DÜRR SOMAC GmbH, Stollberg (DE)

(72) Inventors: Thomas Achatz, Niederdorf (DE); Eric Selbmann, Gersdorf (DE); Frank Wieland, Burkhardtsdorf (DE)

(73) Assignee: DÜRR SOMAC GmbH, Stollberg (DE)

( * ) Notice: Subject to any disclaimer, the term of this patent is extended or adjusted under 35 U.S.C. 154(b) by 29 days.

(21) Appl. No.: 15/129,967

(22) PCT Filed: Mar. 18, 2015

(86) PCT No.: PCT/DE2015/000140
§ 371 (c)(1),
(2) Date: Sep. 28, 2016

(87) PCT Pub. No.: WO2015/149740
PCT Pub. Date: Oct. 8, 2015

(65) Prior Publication Data

US 2017/0137280 A1 May 18, 2017

(30) Foreign Application Priority Data

Mar. 29, 2014 (DE) ..... 10 2014 004 829

(51) Int. Cl.
*B67D 7/42* (2010.01)
*B67D 7/02* (2010.01)
*B67D 7/04* (2010.01)

(52) U.S. Cl.
CPC ..... *B67D 7/425* (2013.01); *B67D 7/02* (2013.01); *B67D 7/04* (2013.01)

(58) Field of Classification Search
CPC ..... B67D 7/04; B67D 7/428
(Continued)

(56) References Cited

U.S. PATENT DOCUMENTS 5,184,309 A * 2/1993 Simpson ..... B67D 7/425 141/392
5,560,407 A * 10/1996 Swinford ..... F16K 3/265 137/625.66
(Continued)

FOREIGN PATENT DOCUMENTS

EP 0450798 A1 10/1991
EP 2369307 A1 9/2011
(Continued)

OTHER PUBLICATIONS

International Search Report for PCT/DE2015/000140 dated Aug. 24, 2015 and English translation, 8 pgs.

*Primary Examiner* — Timothy L Maust
(74) *Attorney, Agent, or Firm* — Harness, Dickey & Pierce, P.L.C.

(57) ABSTRACT

A filling adapter for a container to be filled with media, in particular for the filling of containers on assembly lines for the production of motor vehicles where the filling adapter is equipped with a hose pack, electrical, pneumatic, and hydraulic lines. An interface is configured for coupling a gripping element designed as a separate assembly on the filling adapter in the region of the adapter head, wherein the interface has mechanical and electrical connecting elements which are disposed in a common plane and can be coupled to mechanical and electrical connecting elements of the gripping element which are congruent therewith.

4 Claims, 2 Drawing Sheets

(58) Field of Classification Search
USPC ..... 141/392; 222/144.5
See application file for complete search history.

(56) References Cited

U.S. PATENT DOCUMENTS

| | | | | |
|---|---|---|---|---|
| 6,029,720 | A * | 2/2000 | Swinford | F16K 1/123 137/625.66 |
| 6,257,285 | B1 * | 7/2001 | Robinson | F01P 11/0204 141/21 |
| 6,298,886 | B1 * | 10/2001 | Robinson | B60H 1/00585 137/614.06 |
| 6,799,614 | B1 | 10/2004 | Smith et al. | |
| 7,588,059 | B2 * | 9/2009 | Robinson | F16L 37/23 141/302 |
| 7,729,796 | B2 * | 6/2010 | Hartrampf | B21J 15/043 29/243.53 |
| 9,624,087 | B2 * | 4/2017 | Tuyls | B67D 7/02 |

FOREIGN PATENT DOCUMENTS

| | | | |
|---|---|---|---|
| FR | 3031160 | B1 * | 7/2017 |
| WO | WO-02087969 | A1 | 11/2002 |

* cited by examiner

FILLING ADAPTER COMPRISING AN INTERFACE FOR COUPLING A HANDLE

CROSS-REFERENCE TO RELATED APPLICATIONS

This application is a National Stage of International Application No. PCT/DE2015/000140, filed Mar. 18, 2015, claiming priority to DE 10 2014 004 829, filed Mar. 29, 2014. The entire disclosures of each of the above applications are incorporated herein by reference.

FIELD

The present disclosure relates to a filling adapter for a container to be filled with media (e.g. oils, gases, coolants and the like), in particular for the initial filling of containers with operating substances on assembly lines for the production of motor vehicles, wherein the filling adapter is equipped with a hose pack, electrical, pneumatic and hydraulic lines.

BACKGROUND

This section provides background information related to the present disclosure which is not necessarily prior art.

Containers must be filled with liquids or gases for numerous technical applications. A typical application in this respect are motor vehicles where housings, circuits, equalizing reservoirs and the like have to be filled with fuel, lubricants, coolants, and other operating substances. In the manufacturing process, these vehicles must be filled, for example, with brake fluid, power steering fluid, coolant, refrigerant, windshield wiper fluid, and fuel. These media are fed via hoses and special adapters to the respective circuits of the vehicles. The hoses typically include multiple lines with different functions for vacuum application, back suction, filling, aerating, as well as for electrical cables.

U.S. Pat. No. 6,799,614 B1 describes a respective filling adapter for a container to be filled with media. This filling adapter is particularly designed for the initial filling of containers with operating substances on assembly lines at manufacturers of motor vehicles and is for this purpose equipped with a hose pack as well as electrical, pneumatic and hydraulic lines.

To perform the filling, a worker has to bring filling adapter and hose pack to the vehicle depending on the respective position of the filling station and connect it to the ports of the circuits to be filled. A gripping element into which a worker can grasp with one hand is configured on the adapter for this purpose. The gripping element is either designed as a cover of the hose pack or as a separate handle, which is preferably disposed on the adapter head. But both variants have disadvantages:

The hose cover design results in a great overall length of the entire adapter, which impairs handling by a worker due to the weight and because the center of gravity is often near the front. At the same time, the handle must inevitably have a large diameter, which is outside the dimensions required in standards, because the media lines have to be conducted through the handle.

In the design with a handle on the adapter head, the gripping angle and thus the access position on the container are permanently defined, such that a worker can encounter problems when handling the adapter depending on the exact space and access options available.

SUMMARY

This section provides a general summary of the disclosure, and is not a comprehensive disclosure of its full scope or all of its features.

It is the purpose of the disclosure to create a technical solution with which a gripping element can be disposed on the main body of the filling adapter in a relative position, which position can be varied as required, so as to enable largely optimal handling for the worker while observing the respective specific options for space and access to the container to be filled.

This problem is solved in that an interface is configured for coupling of a gripping element designed as a separate assembly on the filling adapter in the region of the adapter head, wherein the interface has mechanical and electrical connecting elements which are disposed in a common plane and can be coupled to mechanical and electrical connecting elements of the gripping element which are congruent therewith.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

In one proposed embodiment, the gripping element can be moved on the interface. This facilitates advantageous weight balancing between the adapter and the hose pack.

In another embodiment, a control unit is integrated in the gripping element.

The main advantage of the filling adapter design according to the disclosure is that the relative position of the gripping element and the main body of the filling adapter can be modified such that a largely optimal handling for the worker is achieved while observing the respective specific options for space and access to the container to be filled. Depending on the respective conditions of use, various gripping elements can be coupled to the filling adapter—particularly at different angular positions. The standardized interface also enables rapid change, such that one basic design of the filling adapter can be easily modified for different operating conditions. In addition to technical advantages, this also has considerable ergonomic benefits.

Furthermore, the embodiment of a filling adapter according to the disclosure has a reduced overall length, which results in other advantages, such as a shorter distance between the center of gravity of the adapter and the control unit when a worker handles the adapter.

Figure 1:
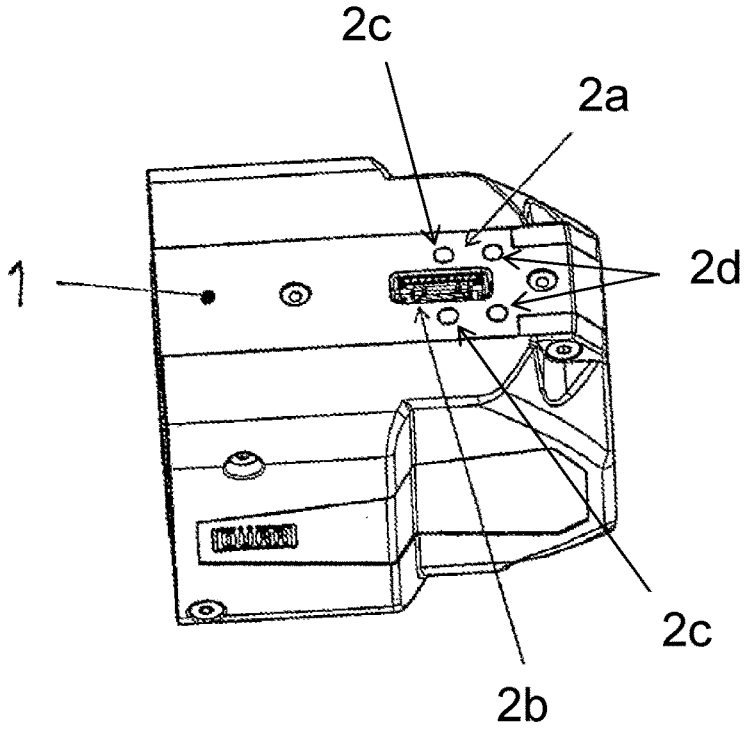
FIG. 1 shows an adapter head with interfaces for mechanical and electrical coupling.
Figure 2:
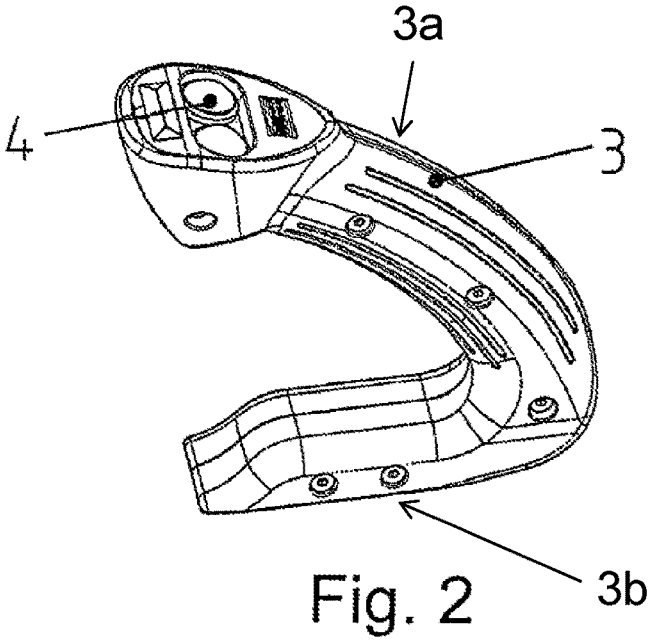
FIG. 2 shows a gripping element with an integrated control unit.
Figure 3:
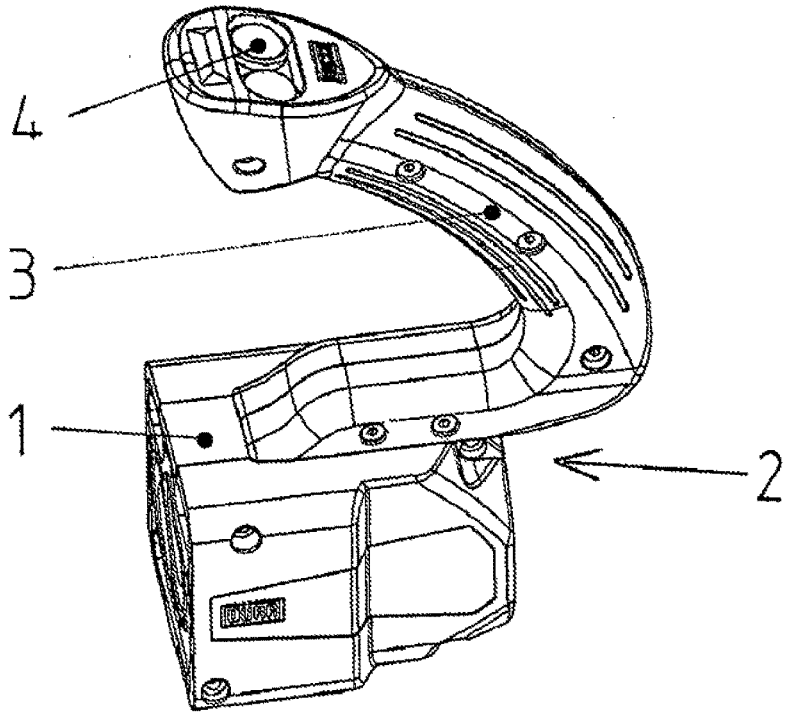
FIG. 3 shows the adapter head according to FIG. 1 with a gripping element according to FIG. 2 coupled to it.

An embodiment according to the disclosure is explained below with reference to the figure. Wherein:

FIG. 1 shows an adapter head with interfaces for mechanical and electrical coupling;

FIG. 2 shows a gripping element with an integrated control unit;

FIG. 3 shows the adapter head according to FIG. 1 with a gripping element according to FIG. 2 coupled to it.

The filling adapter shown in the drawing is particularly designed for the initial filling of containers with various operating substances on assembly lines for the production of motor vehicles. Such filling adapters are equipped in a generally known way with a hose pack as well as electrical, pneumatic, and hydraulic lines. It should be noted that the drawing does not show a complete filling adapter; only the components that are essential for understanding the disclosure.

It is apparent from FIG. 1 that an interface 2 with mechanical (2*a*) and electrical (2*b*) connecting elements is configured in the area of the adapter head 1 on the filling adapter. The connecting elements 2*a* and 2*b* are arranged in a common plane and can be coupled with mechanical and electrical connecting elements of a separate gripping element 3 that are congruent therewith. Mechanical connecting elements 2*a* provide first and second mounting positions (2*c*, 2*d*) on the adapter head 1.

FIG. 2 shows a respective gripping element 3, in which preferably a control unit 4 (as shown here) is integrated. The gripping element 3 includes a handle portion 3*a* and a connection portion 3*b*.

FIG. 3 shows the adapter head 1 of the filling adapter not shown in detail with the gripping element 3 coupled to it. The mechanical and electrical operative connection of these two assemblies 1 and 3 is achieved by the connecting elements configured on the interface 2 of the adapter head 1 and the congruent connecting elements of the gripping element 3.

In the embodiment shown in FIG. 3, the gripping element 3 is disposed at an angle of 90° on the outer contour of the adapter head 1. Other angles are possible depending on the detailed spatial conditions on the assembly line, the spatial layout of the containers to be filled in the vehicle and other conditions of use, so that largely optimal handling by the worker can be achieved.

Furthermore, the gripping element 3 can be moved along the interface 2 between the first and second mounting positions 2*c*, 2*d*. The weight can largely be balanced between the filling adapter and the hose pack due to the respective relative position. This also improves handling for the worker.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A filling adapter for the initial filling of containers with operating substances on assembly lines for the production of motor vehicles and of the type including a hose pack, electrical lines, pneumatic lines and hydraulic lines, the filling adapter comprising:

an adapter head comprising an interface comprising a first electrical connector and a first mechanical connector disposed in a common plane on the adapter head, the first mechanical, connector providing a first connection position and a second connection position;

a gripping element comprising a handle portion and a connection portion comprising a second electrical connector and a second mechanical connector; and wherein the gripping element is releasably attached to the interface of the adapter head at the connection portion;

wherein the second electrical connector of the gripping element is matingly coupled to the first electrical connector when the gripping element is attached to the adapter head;

wherein the second mechanical connector of the gripping element is selectively matingly coupled to the first mechanical connector in either the first connection position or in the second connection position when the gripping element is attached to the adapter head to balance the weight of the filling adapter.

2. The filling adapter of claim 1, further comprising a plurality of interchangeable gripping elements, each gripping element respectively configured for releasably attaching to the interface of the adapter head.

3. The filling adapter of claim 2, wherein each of the plurality of gripping elements comprises a different angular position between the connection portion of the respective gripping element and the handle portion of the of the respective gripping element.

4. The filling adapter of claim 1 wherein the gripping element further comprises a control unit integrated into the handle portion.

* * * * *